US010648707B2

(12) United States Patent
Hsu

(10) Patent No.: US 10,648,707 B2
(45) Date of Patent: May 12, 2020

(54) THERMOELECTRIC DEHUMIDIFICATION ROD

(71) Applicant: Tsang-Hung Hsu, Tainan (TW)

(72) Inventor: Tsang-Hung Hsu, Tainan (TW)

( * ) Notice: Subject to any disclaimer, the term of this patent is extended or adjusted under 35 U.S.C. 154(b) by 284 days.

(21) Appl. No.: 15/099,889

(22) Filed: Apr. 15, 2016

(65) Prior Publication Data

US 2017/0299235 A1 Oct. 19, 2017

(51) Int. Cl.
*F25B 21/02* (2006.01)

(52) U.S. Cl.
CPC ..... *F25B 21/02* (2013.01)

(58) Field of Classification Search
USPC ..... 62/3.4, 3.5, 3.6
See application file for complete search history.

(56) References Cited

U.S. PATENT DOCUMENTS 5,640,951 A * 6/1997 Huddart ..... A61M 16/08 128/203.26
7,036,575 B1 * 5/2006 Rodney ..... A47C 21/048 165/138
2011/0266276 A1 * 11/2011 Whitney ..... H05B 6/56 219/548

* cited by examiner

*Primary Examiner* — Elizabeth J Martin
*Assistant Examiner* — Melodee Jefferson
(74) *Attorney, Agent, or Firm* — Rosenberg, Klein & Lee

(57) ABSTRACT

A thermoelectric dehumidification rod comprises a bendable heat-dissipation tube formed with a wave structure at the surface, a thermoelectric element set in the heat-dissipation tube, and a power cable. Both ends of the heat-dissipation tube are covered by an end cap, respectively. The power cable is through one of the end caps and electrically connected with the thermoelectric element. Accordingly, the thermoelectric dehumidification rod is bendable and has the closed tube to protect the thermoelectric element. Furthermore, the wave surface of the heat-dissipation tube increases its surface area, enhancing the dissipation effect. Moreover, the thermoelectric dehumidification rod could be put on the curved surface due to its bendable characteristic, shortening the linear length of the whole thermoelectric dehumidification rod, or in a space which size is smaller than the linear length of the unbended thermoelectric dehumidification rod, so it is convenient for use and has more economic benefit.

4 Claims, 7 Drawing Sheets

THERMOELECTRIC DEHUMIDIFICATION ROD

BACKGROUND OF THE INVENTION

Field of the Invention

The present invention relates to a thermoelectric dehumidification rod. More particularly, the thermoelectric dehumidification rod has stronger dissipation effect and is bendable according to the actual space size and shape for fitting the space size, or the linear length of the thermoelectric dehumidification rod could be shortened to fit the curved space or the space which width, length, or height is smaller than the unbended thermoelectric dehumidification rod.

Description of Related Art

Mold is one kind of fungi, existing wildly in nature. It grows easily in the unventilated and moist environment. Because mold likes to grow in the moist environment and has well fecundity, the clothes and valuable objects must be well protected in dehumidification and damp-proof situation. The humidity in the environment can be decreased by some dehumidifier, making the environment keep in dry to decrease the growth of the mold or bacteria.

The general dehumidifiers are divided into two kinds. One kind is condensing dehumidifier, which is put at somewhere and operates by electrical power, but its volume is too huge to transport, it usually is used to improve the humidity of a big space. The other kind is some chemical materials, such as calcium chloride, which can be put in a small space and has the characteristic that can easily absorb the water molecule in the air. The moisture-proof bag put in the food package or the moisture-proof box put in the closet is common. However, in this dehumidification method, the chemical material is consumed and need to be constantly replenished, it is inconvenience.

Moreover, a thermoelectric dehumidifier for general home cabinets has been developed on the market to decrease the humidity in cabinets for keeping the stored goods dry. Please refer to FIG. 7, showing a three-dimensional view of a thermoelectric dehumidifier 5 of a prior art, which mainly dehumidifies via an electric heating method. However, the heat-dissipation tube is a hard tube having a flat surface, so it is limited by the surface area of the tube to make the heat-dissipation effect poor. Furthermore, the hard tube is unbendable, so it cannot be obediently fixed in the curved cabinets. In addition, the length of the thermoelectric dehumidifier 5 should be shorter than the space size of the cabinet; otherwise, the thermoelectric dehumidifier 5 cannot be put into the cabinet. Accordingly, the different length of the thermoelectric dehumidifiers should be prepared for the cabinet with different size or shape, resulting in wasteful.

SUMMARY OF THE INVENTION

A thermoelectric dehumidification rod comprises a thermoelectric element, a bendable heat-dissipation tube formed with a wave structure at the surface, and a power cable. The thermoelectric element is set in the bendable heat-dissipation tube, and both ends of the bendable heat-dissipation tube are covered by an end cap, respectively. The power cable is through one of the end caps and electrically connected with the thermoelectric element. Accordingly, the thermoelectric dehumidification rod has bigger surface area for heat-dissipation and is bendable.

According to an embodiment of the present invention, the bendable heat-dissipation tube is a bellows structure, thereby being stretchable and bendable.

According to an embodiment of the present invention, the bendable heat-dissipation tube comprises several spiral rings. One side of each spiral ring is an embedding part and the side opposite the embedding part is a hook part, which hook part is assembled with the embedding part of the adjacent spiral ring, making the heat-dissipation tube bendable. Whether the tube is in straight or bending situation, the heat-dissipation tube is formed with a continuous and closed wall for protecting the thermoelectric element in the tube.

The advantages of the thermoelectric dehumidification rod of the present invention are described as below.

Due to the bendable characteristic of the bendable heat-dissipation tube, the linear length of the whole thermoelectric dehumidification rod is shortened to fit the shape of a space or to be put in a space which has a size that is smaller than the linear length of the unbent thermoelectric dehumidification rod, so it is convenient for use and has a greater economic benefit.

DETAILED DESCRIPTION OF THE PREFERRED EMBODIMENT

Figure 1:
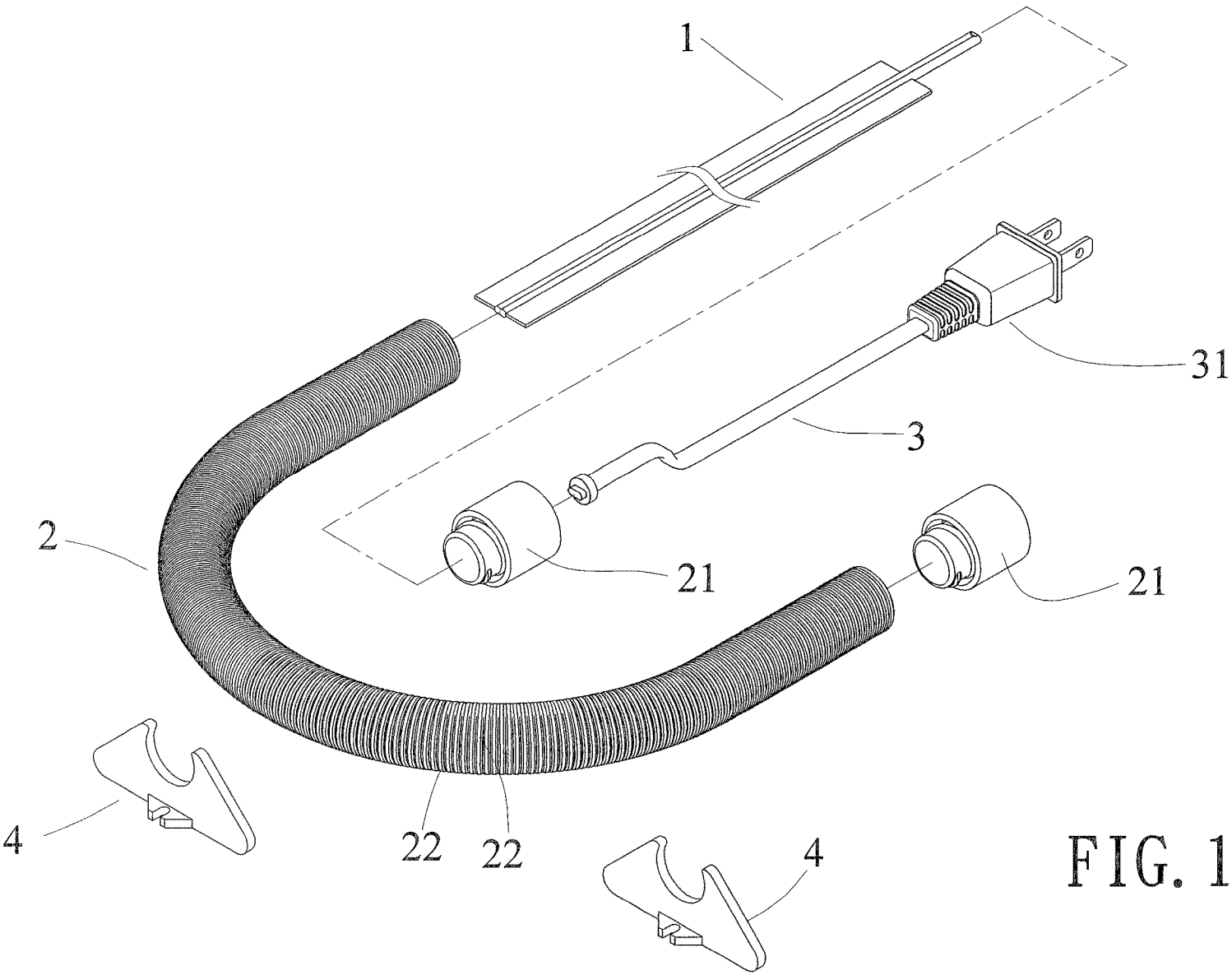
FIG. 1 is an exploded perspective view of a thermoelectric dehumidification rod according to an embodiment of the present invention.
Figure 2:
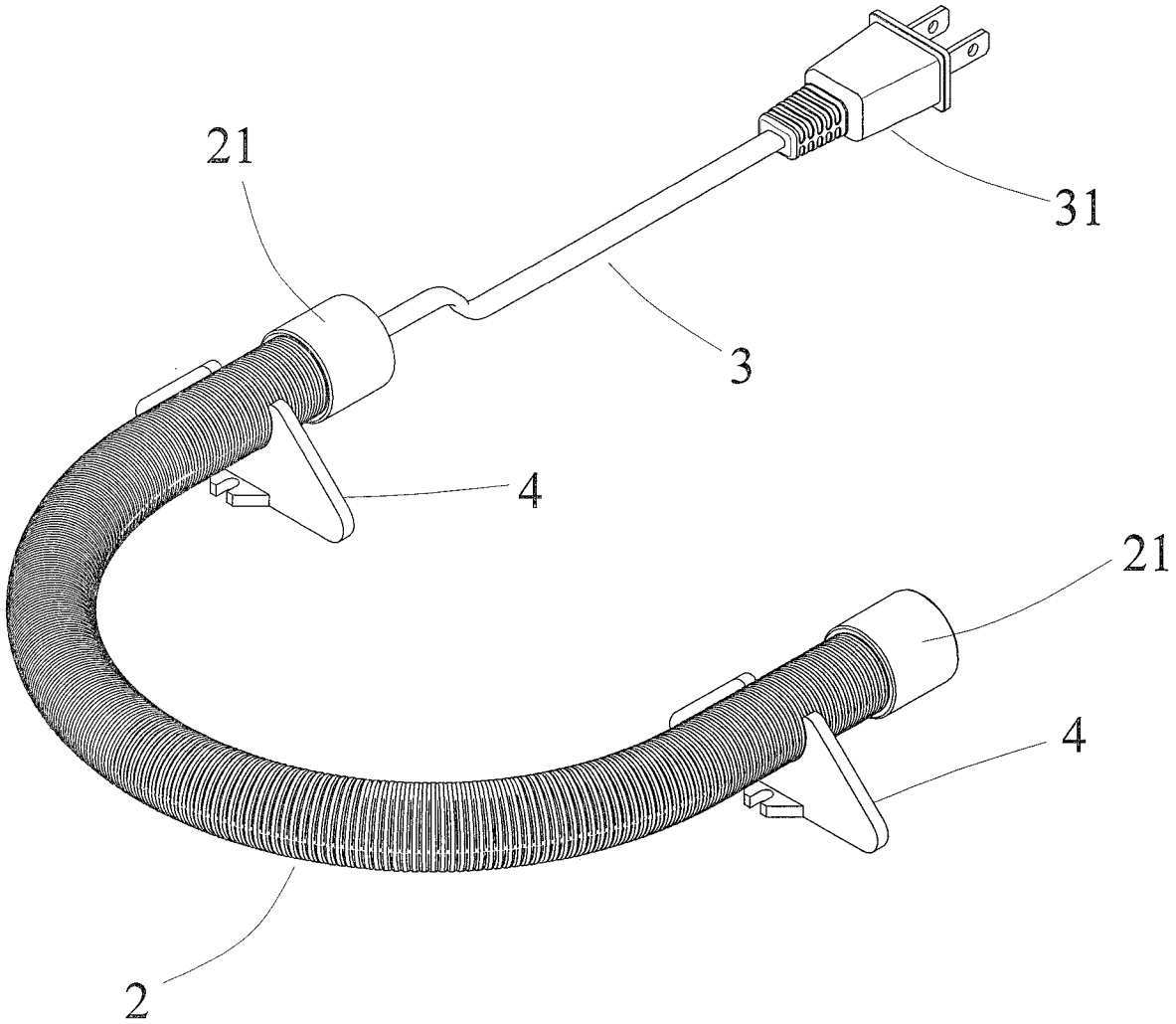
FIG. 2 is a three-dimensional view of a thermoelectric dehumidification rod at bended situation according to an embodiment of the present invention.

Please refer to FIG. 1 and FIG. 2. The thermoelectric dehumidification device comprises a thermoelectric element 1, a bendable heat-dissipation tube 2, and a power cable 3.

The thermoelectric element 1 is capable of generating heat and is a soft structure, such as a thermoelectric wire.

The bendable heat-dissipation tube 2 is a hollow and bendable tube which has an internal channel extending longitudinally internally of the heat dissipation tube 2 between two ends thereof. The thermoelectric element 1 is set within the internal longitudinal channel of the bendable heat-dissipation tube 2, and both ends of the bendable heat-dissipation tube 2 are covered by an end cap 21, respectively.

One end of the power cable 3 is a plug 31 for connecting with a socket (not shown) in a building, and the other end of the power cable 3 is through one of the end caps 21 into the internal longitudinal channel of the heat-dissipation tube 2 to electrically connect to the thermoelectric element 1. The electrical power is supplied via the power cable 3 to the thermoelectric element 1.

Figure 6:
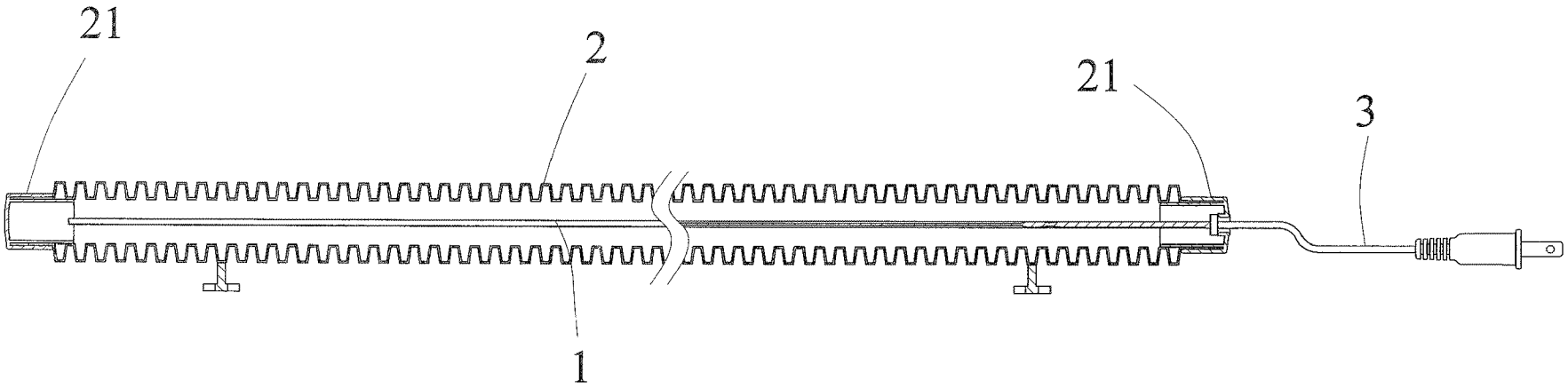
FIG. 6 is a sectional view of a thermoelectric dehumidification rod according to another embodiment of the present invention.
Figure 7:
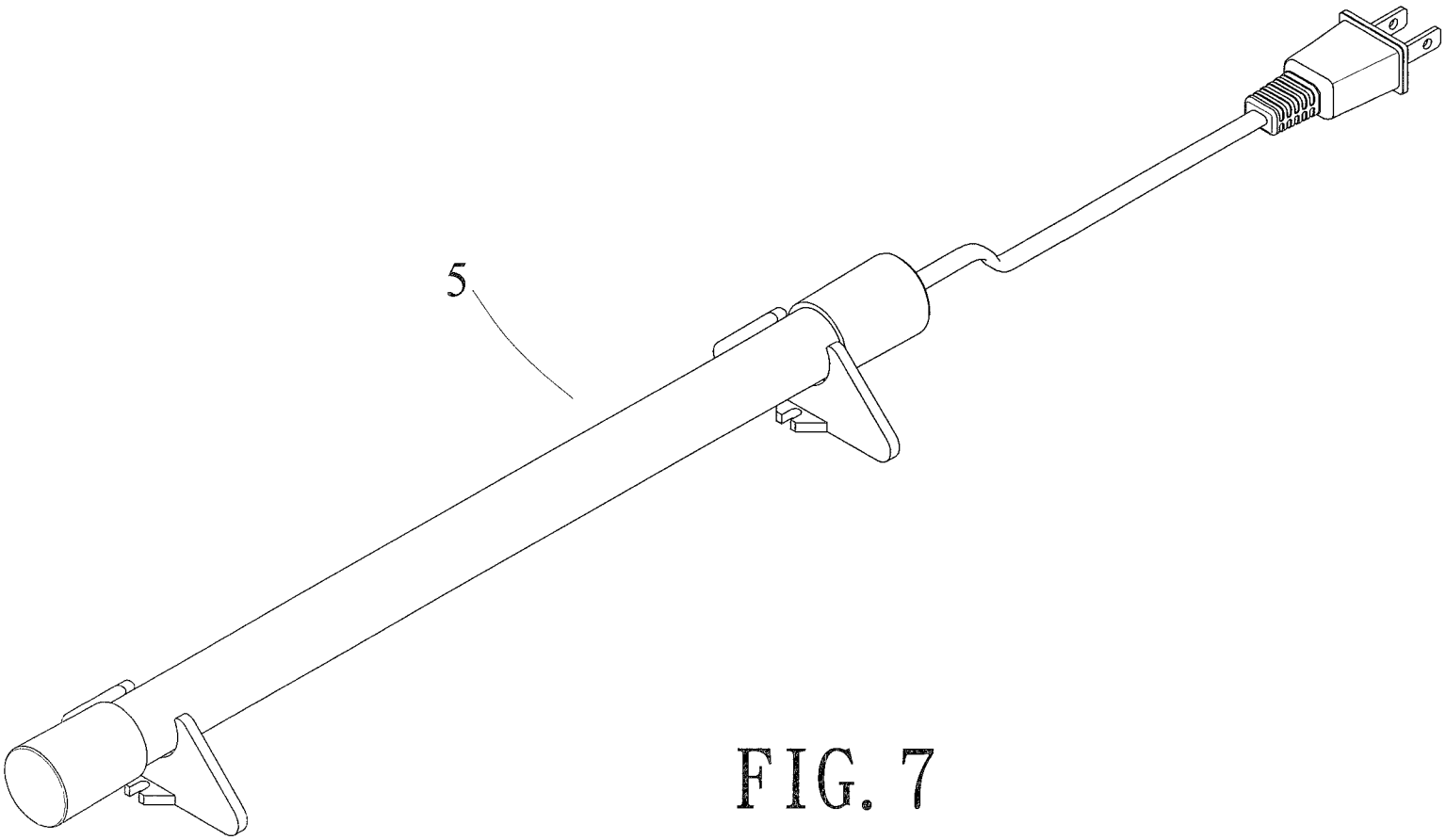
FIG. 7 (PRIOR ART)
FIG. 7 is a three-dimensional view of a thermoelectric dehumidifier of a prior art.

Please refer to FIG. 6. According to an embodiment of the present invention, the wave structure at the surface of the bendable heat-dissipation tube 2 is a bellows structure, thereby being stretchable and bendable.

Figure 3:
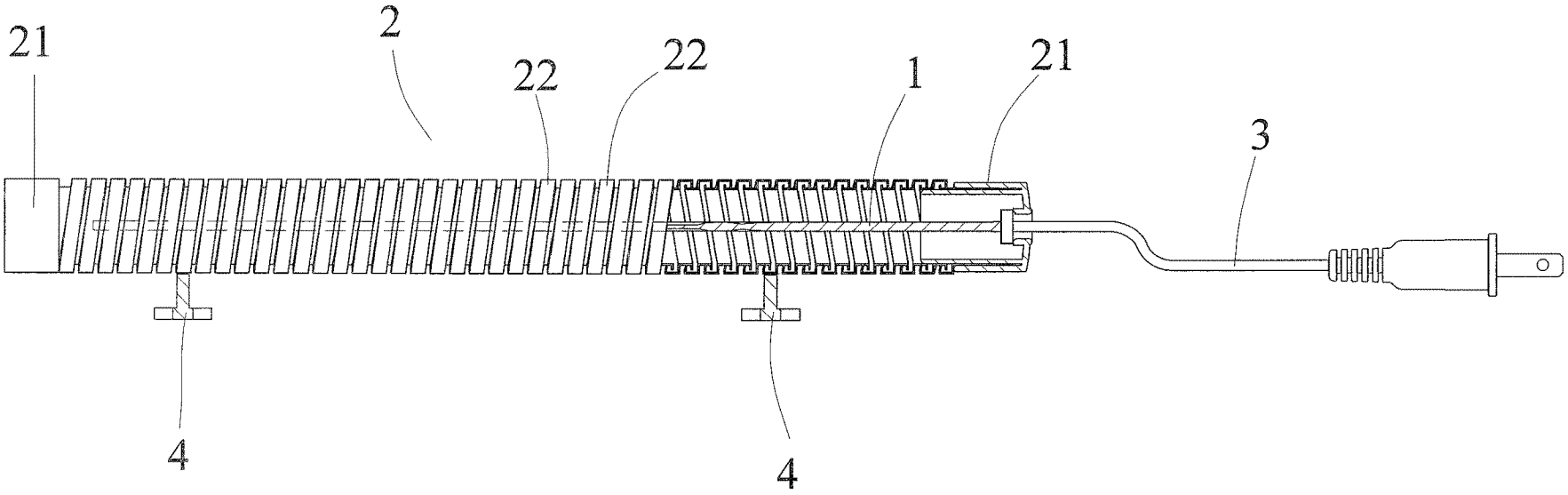
FIG. 3 is a partial sectional view of a thermoelectric dehumidification rod according to an embodiment of the present invention.
Figure 4:
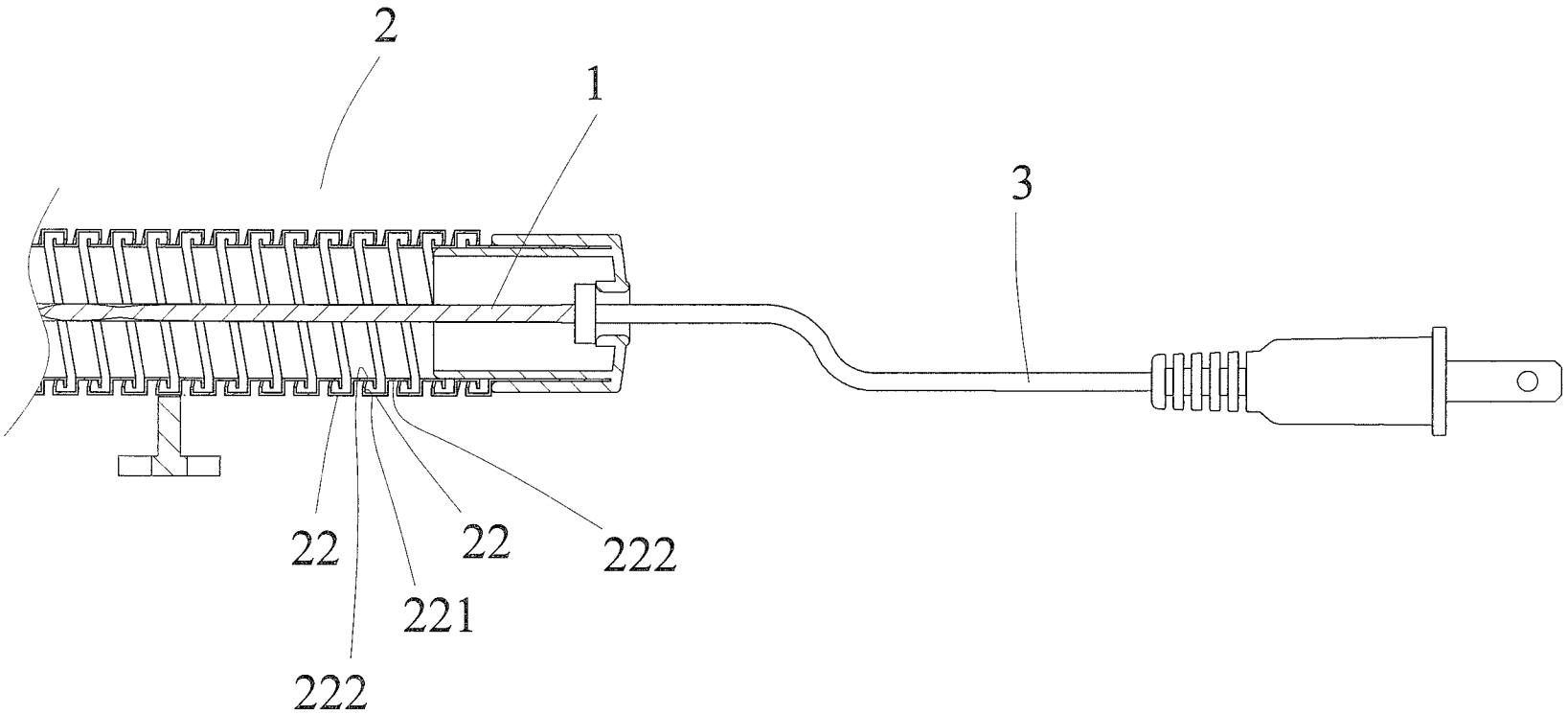
FIG. 4 is a partial enlarged view of FIG. 3.
Figure 5:
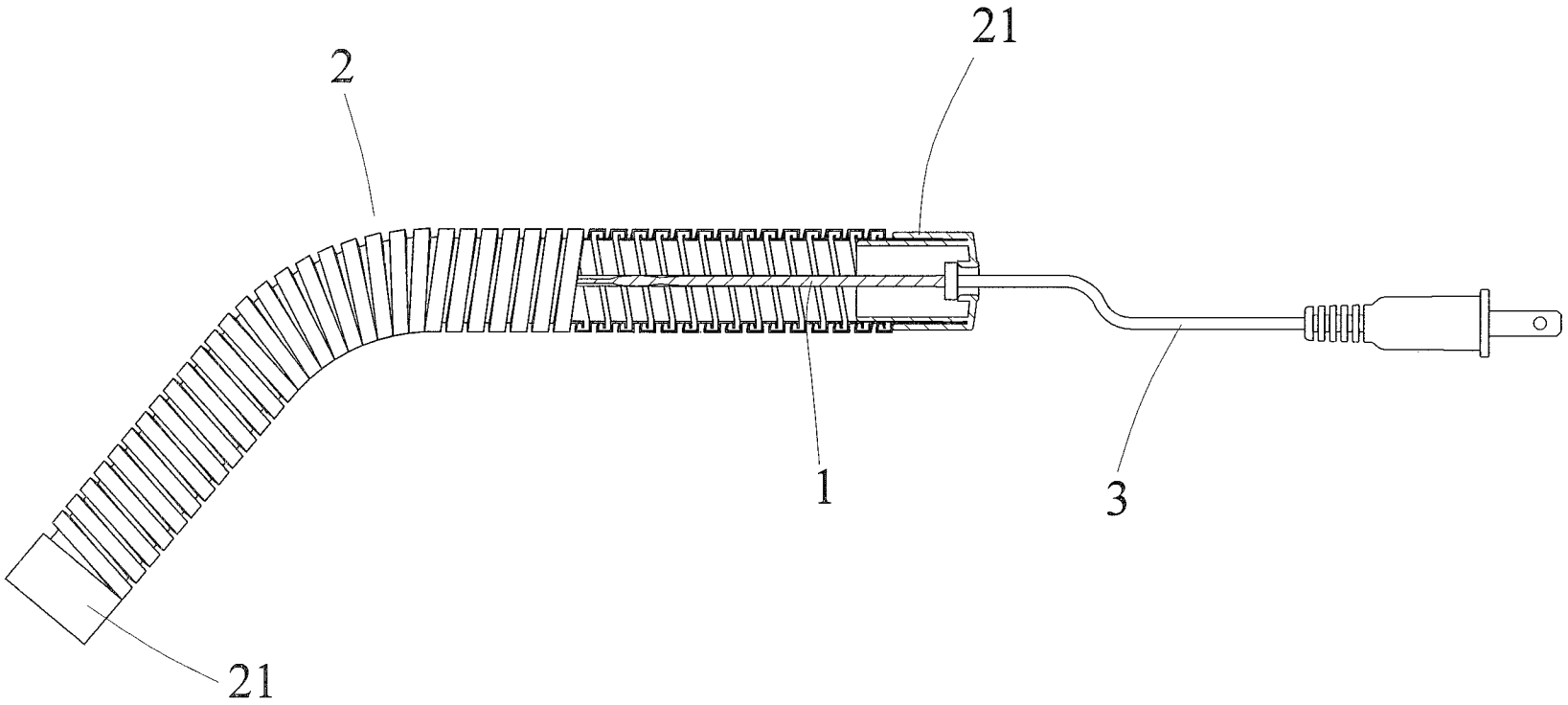
FIG. 5 is a partial sectional view of a thermoelectric dehumidification rod at bended situation according to an embodiment of the present invention.

Please refer to FIG. 3 to FIG. 5. The wave structure of the bendable heat-dissipation tube 2 consists of several spiral rings 22 connected with one another. One side of each spiral ring 22 is an embedding part 221 and the side opposite the embedding part 221 is a hook part 222, which hook part 222 is assembled with the embedding part 221 of the adjacent spiral ring 22. Accordingly, the heat-dissipation tube 2 is bendable, and whether the tube is in straight or bending situation, the heat-dissipation tube is formed with a continuous and closed wall for protecting the thermoelectric element in the tube.

Please refer to FIG. 2 and FIG. 5. When the thermoelectric dehumidification rod is used, it is directly put in the cupboard or is supported by two fixing bases 4 which are fixed on the wall of the cupboard. When the inner space of the cupboard is curved, or the width, the height or the length of the space is smaller than the length of the thermoelectric dehumidification rod of the present invention, the thermoelectric dehumidification rod can be bent to fit the space shape or the whole straight length of the thermoelectric dehumidification rod of the present invention is shortened, for smoothly putting it in the cupboard to dehumidify, so it is very convenient for use and has more economic benefit.

What is claimed is:

1. A thermoelectric dehumidification rod, comprising:

a bendable heat-dissipation tube having a hollow tube body formed with a continuous wall and a longitudinal channel defined by said wall and extending internally in said hollow heat-dissipation tube between opposing ends thereof, said wall of the bendable heat-dissipation tube being formed with an outer surface having a wave shaped contour, said hollow tube body including a plurality of spiral rings formed thereon and connected with one another, wherein each of the plurality of spiral rings has one side thereof formed as an embedding part and an opposing side opposite to the embedding part formed as a hook part, said hook part being assembled with the embedding part of an adjacent spiral ring, wherein each of the opposing ends of the bendable heat-dissipation tube is covered by a corresponding end cap;

an elongated thermoelectric element having a soft structure and extending within said internal longitudinal channel substantially along the entire length of the hollow bendable heat-dissipation tube between said opposing ends thereof and bendable in compliance therewith; and a power cable, passing into the internal longitudinal channel of said hollow bendable heat-dissipation tube through one of the end caps, said power cable being electrically connected with the thermoelectric element;

whereby the thermoelectric dehumidification rod is mountable in a space smaller than a length of the bendable heat-dissipation tube by the bending thereof with the bendable heat-dissipation tube protecting the thermoelectric element extending therein.

2. The thermoelectric dehumidification rod according to claim 1, wherein the bendable heat-dissipation tube is a bellows structure, thereby being stretchable and bendable.

3. The thermoelectric dehumidification rod according to claim 1, wherein each spiral ring has an S-shaped cross-section.

4. The thermoelectric dehumidification rod according to claim 3, wherein the S-shaped cross-section of each spiral ring is angular.

* * * * *